US008943695B2

(12) United States Patent
Forsström et al.

(10) Patent No.: US 8,943,695 B2
(45) Date of Patent: Feb. 3, 2015

(54) METHOD FOR INSTALLING THE HOISTING ROPING OF AN ELEVATOR

(71) Applicant: Kone Corporation, Helsinki (FI)

(72) Inventors: Niko Forsström, Hyvinkää (FI); Osmo Björni, Hyvinkää (FI); Jarmo Ahoniemi, Jokela (FI)

(73) Assignee: Kone Corporation, Helsinki (FI)

( * ) Notice: Subject to any disclaimer, the term of this patent is extended or adjusted under 35 U.S.C. 154(b) by 264 days.

(21) Appl. No.: 13/667,573

(22) Filed: Nov. 2, 2012

(65) Prior Publication Data

US 2013/0111723 A1 May 9, 2013

(30) Foreign Application Priority Data

Nov. 4, 2011 (FI) ..... 20116094

(51) Int. Cl.
*B66B 19/00* (2006.01)
*B66B 19/02* (2006.01)

(52) U.S. Cl.
CPC ..... *B66B 19/02* (2013.01); *B66B 19/007* (2013.01)
USPC ..... 29/897; 29/892.1; 29/401.1; 187/264; 187/254; 187/414

(58) Field of Classification Search
USPC ..... 29/897, 897.2, 892.1, 401.1, 428, 29/426.1, 402.11, 402.03, 402.08; 187/264, 266, 254, 251, 256, 408, 249, 187/350, 414
See application file for complete search history.

(56) References Cited

U.S. PATENT DOCUMENTS

| | | | | |
|---|---|---|---|---|
| 5,000,292 | A * | 3/1991 | Chapelain et al. | 187/408 |
| 8,205,720 | B2 * | 6/2012 | Barneman | 187/266 |
| 8,448,323 | B2 * | 5/2013 | Leckman et al. | 29/402.08 |

* cited by examiner

*Primary Examiner* — David Bryant
*Assistant Examiner* — Jun Yoo
(74) *Attorney, Agent, or Firm* — Birch, Stewart, Kolasch & Birch, LLP

(57) ABSTRACT

Method for installing the hoisting roping of an elevator, wherein the first elevator unit to be moved is disposed at a suitable point in the elevator hoistway, and the second elevator unit to be moved is disposed at a suitable point in the elevator hoistway, which first elevator unit is an elevator car and which second elevator unit is a counterweight, or vice versa. The first and/or second section of the hoisting roping is connected to its elevator unit via a diverting pulley system such that when the diverting pulley system is still separate from the elevator unit, the section in question of the hoisting roping is arranged to travel under the diverting pulley system of its elevator unit, and the diverting pulley system is lowered, when reeved, downwards into the proximity of its elevator unit, after which the diverting pulley system in question is fixed to its elevator unit.

19 Claims, 7 Drawing Sheets

METHOD FOR INSTALLING THE HOISTING ROPING OF AN ELEVATOR

FIELD OF THE INVENTION

The object of the invention is a method for installing the hoisting roping of an elevator, which elevator is preferably an elevator applicable to passenger transport and/or to freight transport.

BACKGROUND OF THE INVENTION

The invention relates to a method for installing the hoisting roping of an elevator, more particularly to a method wherein the hoisting roping is arranged such that it travels over a diverting pulley in the finished elevator, which diverting pulley is supported in its position in a manner allowing its rotation, e.g. a traction sheave in a machine room, and supports the moving elevator units of the elevator while it is supported on the aforementioned diverting pulley. This is typically effected by connecting a first section of the hoisting roping on a first side of the aforementioned diverting pulley to support a first elevator unit and by connecting the second section of the hoisting roping on the second side of the diverting pulley to support a second elevator unit. In prior art it has been possible to thread the hoisting roping end first to travel the desired route. The hoisting roping has been guided in this way, e.g. in the case of a 2:1 elevator, to the elevator car, and to pass around the bottom of a diverting pulley on the elevator car and up to the aforementioned diverting pulley, over the top of it, and down to the counterweight, under the diverting pulley of said counterweight and again upwards. After this the ends of the roping are fixed into position. One problem in this solution, as also in other solutions according to prior art, has been the slowness of the method. The method has required a fitter to repeatedly move between working points that are a distance from each other or otherwise a number of fitters have had to work simultaneously at the different working points. Likewise, threading a rope end first causes a large resistance to the pulling in the final phases as each rope of the roping is pulled a long distance through the whole system. The self-masses of the ropes of the roping also cause special attention or arrangements, because a rope traveling in the vertical direction must be continuously supported so that it does not fall or pull the part of the rope already threaded back. Falling of the rope could cause a dangerous situation. Likewise, freely hanging parts of a rope could swing in the lateral direction and adhere to the hoistway. One problem has been that in elevators having hoisting roping comprising a number of ropes, sometimes very many ropes, the total installation time can at worst become long because a larger number of ropes is more complicated and more laborious to manage or to move.

Hoisting roping is generally always installed when a new elevator is being fabricated, but also when replacing old hoisting ropes, e.g. in connection with modernization, new hoisting roping is installed that replaces the old hoisting roping. Often in modernization an elevator is modified by replacing old elevator components with new ones, e.g. the hoisting machine can be modernized. There can also be a need to change the route of the hoisting roping and/or the number of ropes in the hoisting roping.

GENERAL DESCRIPTION OF THE INVENTION

An aim of the invention is to solve the problems of prior-art solutions and to produce an improved installation method for the hoisting roping of an elevator, more particularly when it is intended to connect via a diverting pulley system an elevator unit to an elevator unit to be moved. A further aim is to achieve a method with which one or more of the following advantages, among others, are achieved:

- An installation method for hoisting roping is achieved that is faster than before, particularly if the hoisting roping comprises a plurality of ropes.
- An installation method for hoisting roping is achieved that makes possible a safe working point for a fitter.
- An installation method for hoisting roping is achieved wherein the moving of the roping from the machine room into the elevator hoistway and/or in the elevator hoistway occurs in a controlled manner.
- An installation method for hoisting roping is achieved that requires few fitters.
- An installation method for hoisting roping is achieved that is well suited for reeving an elevator with machine room.
- An installation method for hoisting roping is achieved that is well suited for reeving a new elevator, or for the re-reeving of an old elevator with machine room in connection with rope replacement or in connection with modernization.

In the method according to the invention for installing the hoisting roping of an elevator, the first elevator unit to be moved is disposed at a suitable point in the elevator hoistway, preferably in its top end, and the second elevator unit to be moved is disposed at a suitable point in the elevator hoistway, preferably in the bottom end of the elevator hoistway or otherwise lower than the first elevator unit, which first elevator unit is an elevator car and which second elevator unit is a counterweight, or vice versa, and the hoisting roping is arranged to travel over a diverting pulley supported in its position in a manner allowing its rotation and to support the aforementioned elevator units while supported on the diverting pulley in question, which is preferably a traction sheave in the machine room, by connecting a first section (a) of the hoisting roping on a first side of the diverting pulley to support a first elevator unit, and by connecting the second section (b) of the hoisting roping on the second side of the diverting pulley to support the second elevator unit, such that the first (a) and/or the second section (b) of the hoisting roping support(s) their elevator unit(s) via a diverting pulley system. In the method the first section (a) and/or the second section (b) of the hoisting roping is/are connected to their elevator unit via the diverting pulley system of the elevator unit in question such that when the aforementioned diverting pulley system is still separate from the elevator unit, preferably still in the machine room, the section in question (a,b) of the hoisting roping, more particularly the section (a,b) between the end of the section in question (a,b) and the diverting pulley, is arranged to travel under the diverting pulley system of its elevator unit, and the diverting pulley system is lowered, when reeved, downwards into the proximity of its elevator unit, after which the diverting pulley system in question is fixed to its elevator unit. In this way the aforementioned advantages are achieved. The hoisting roping can thus simply and quickly be connected to its elevator unit, even if the roping were to comprise a large number of ropes. Connecting the hoisting roping can be performed with a small number of work phases. Another advantage also is that the working position can be ergonomic and very safe for a large part of the installation time.

In one embodiment before the aforementioned lowering of the diverting pulley system(s), when reeved, downwards into the proximity of its/their elevator unit(s), more particularly before the diverting pulley system(s) is/are lowered out of the machine room into the elevator hoistway, the hoisting roping is arranged to travel over the aforementioned diverting pulley supported in its position in a manner allowing its rotation, more particularly such that the hoisting roping travels under the diverting pulley system of the first elevator unit and to the aforementioned diverting pulley supported in its position in a manner allowing its rotation, and over that and onwards under the diverting pulley system of the second elevator unit. One advantage is that by pre-reeving the roping of the aforementioned components, the routing can be performed quickly and safely, e.g. in the machine room without moving backwards and forwards along the final route of a rope. The hoisting roping to the first diverting pulley system preferably travels from a rope storage, which is preferably in the machine room. During the lowering the second end of the hoisting roping is preferably supported in its position. The first end can be in the rope storage during the lowering, in which case the additional rope needed can run from the rope storage.

In one embodiment the aforementioned diverting pulley supported in its position in a manner allowing its rotation is the traction sheave of the hoisting machine of the elevator.

In one embodiment the aforementioned diverting pulley system is lowered, when reeved, downwards towards its elevator unit, preferably until it is in the proximity of it, supported by the part (a,b) of the hoisting roping traveling under the diverting pulley system in question. Thus awkward supporting arrangements for the diverting pulley system or for the roping are not needed. The supporting can be performed simply e.g. from the machine room.

In one embodiment in the method the aforementioned diverting pulley system is lowered, when reeved, downwards towards its elevator unit, preferably until it is in the proximity of it, supported by the part (a,b) of the hoisting roping traveling under the diverting pulley system in question by supporting the section of hoisting roping traveling under the diverting pulley system while supported on supporting points, which act on the hoisting roping on opposite sides of the diverting pulley system. This is an inexpensive and simple method of implementing the supporting of a diverting pulley system while moving it.

In one embodiment in the method the aforementioned diverting pulley system is lowered, when reeved, downwards towards its elevator unit, preferably until it is in the proximity of it, supported by the part (a,b) of the hoisting roping traveling under the diverting pulley system in question by supporting the section (a,b) of hoisting roping traveling under the diverting pulley system while supported on supporting points, which act on the hoisting roping on opposite sides of the diverting pulley system, and by lengthening the length of the part of the hoisting roping between the supporting points until the diverting pulley system has lowered to a suitable point, preferably into the proximity of its elevator unit. Thus the supporting points can be kept essentially in their position and the diverting pulley system can be lowered downwards in a controlled manner at the desired speed. Thus the hanging loop of the hoisting roping also automatically settles to be suitable in length both for its intended route in the hoistway downwards to the diverting pulley system as well as back. The supporting can also in this way be performed simply e.g. from the machine room.

In one embodiment the one supporting point is the aforementioned diverting pulley, which is the traction sheave of the hoisting machine of the elevator, and preferably the other supporting point is a supporting means of the end of the roping, such as a rope clamp. In this way the traction sheave can be utilized in the supporting, and it is not necessary to perform separate gripping on the point in question of the roping. Likewise, in this case increasing the length between the supporting points can be done by rotating the traction sheave safely and simply.

In one embodiment at least the one supporting point is formed by manually gripping the roping. On the other hand, even both the aforementioned supporting points can be implemented in this way. Manual gripping is very quick to implement and, at least when the elevator unit is near, the length of the hoisting roping between the supporting points can be increased when lowering by manually braking and permitting gravity to lengthen the length in question. Utilizing manual gripping is advantageous at least in connection with lowering a diverting pulley system into the elevator hoistway, onwards from where the supporting can be of another type.

In one embodiment in the method the length of the part of the hoisting roping between the supporting points is increased by displacing the hoisting roping over the diverting pulley from the first side to the second side by rotating the diverting pulley, and the hoisting roping is arranged to be released at the same time on the first side of the diverting pulley from the rope storage, e.g. from a rope reel/reels, from which the hoisting roping travels to the first elevator unit. In this way a very controlled lowering of the diverting pulley system is achieved simply. The aforementioned diverting pulley can be used as a supporting point, utilizing the grip between the hoisting roping and the diverting pulley. The rope storage is preferably in the machine room.

In one embodiment the diverting pulley is the traction sheave of the hoisting machine of the elevator, on which traction sheave a power means operating with the elevator control, and preferably also a brake, are arranged to act, and for lengthening the part of the roping between the supporting points the traction sheave is rotated by driving the hoisting machine of the elevator, preferably by driving the hoisting machine in the service drive mode of the elevator. Service drive, which is present in most elevators, can thus be used for this, and is well suited in terms of its availability and reliability for lowering of a diverting pulley system. Rotation of the traction sheave is preferably acted on by aid of the drive of the hoisting machine, which drive acts on the traction sheave via the power means (e.g. a motor) of the hoisting machine. By the aid of the power means, according to need, the rotation of the traction sheave is either allowed (if necessary with braking) or if necessary producing rotation in the traction sheave with the power means, depending on the prevailing power balance. An alternative to the driving of the hoisting machine is the releasing of the machinery brake such that it brakes the rotation of the traction sheave and thus the lowering of the diverting pulley system is controlled.

In one embodiment in the method the section (a,b) in question of the hoisting roping, more particularly the section (a,b) between the end of the section (a,b) in question and the diverting pulley, is arranged to travel under the diverting pulley system of its elevator unit when the aforementioned diverting pulley system of the elevator unit is still separate from the elevator unit and is disposed in the machine room, after which the diverting pulley system in question is lowered, when reeved, through an aperture in the floor of the machine room into the elevator hoistway. In this way the hoisting roping and diverting pulley can be displaced towards their final position simply. During this lowering the diverting pulley system is preferably supported by the part (a,b) of the hoisting roping traveling under the diverting pulley system in question, preferably while being supported in one of the aforementioned ways.

In one embodiment in the method a diverting pulley system, which is preferably the diverting pulley system of the second elevator unit, is fixed in the elevator hoistway to a guidance device, which comprises guides, such as e.g. sliding guides or roller guides, which are supported to receive lateral support from the guide rails of the elevator, after which the diverting pulley system is lowered, when reeved, downwards into the proximity of its elevator unit, which is preferably the second elevator unit, guided in the lateral direction by the guidance device. In this way the descent is controlled despite the possibly large number of ropes and a high lowering speed can be maintained. Entanglement of the hoisting roping with the hoistway is avoided. The lowering is preferably performed in the manner described above while supported by the section traveling below the diverting pulley system.

Preferably in the embodiment the first elevator unit to be moved is an elevator car and the second elevator unit to be moved is a counterweight.

In one embodiment in the method the first elevator unit to be moved is disposed in the top end of the elevator hoistway, and is supported in its position so as to be stationary, and the second elevator unit to be moved is disposed in the elevator hoistway, in the bottom end of the elevator hoistway or otherwise lower than the first elevator unit, and is supported in its position, and while working on a platform, preferably on the roof, of the first elevator unit in the top end of the elevator hoistway, the lowering of the diverting pulley system of the second elevator unit is prepared, in which case preferably the diverting pulley system of the second elevator unit is fixed to the guidance device. In this way it is safe for a fitter to work.

In one embodiment in the method the first section (a) of the hoisting roping is first connected to the first elevator unit, preferably via a diverting pulley system of the first elevator unit, and after that the second section (b) is connected to the second elevator unit via a diverting pulley system of the second elevator unit. In this way a small number of components moves at the same time and the method stays securely under control. The connection is preferably performed in the manner described above.

In one embodiment the hoisting roping comprises a plurality of ropes, preferably at least 8 ropes, preferably at least 16 ropes. In this context the method works extremely advantageously and provides great benefits because the ropes can in this case be formed to be narrow and they bend in a small space.

In one embodiment the hoisting roping comprises a plurality of ropes, which bend around the aforementioned diverting pulley system side by side concentrically.

In one embodiment the hoisting roping comprises a plurality of ropes, which bend around the aforementioned diverting pulley system side by side, forming a rope mat comprising parallel ropes, and the ratio of the bending diameter of the diverting pulley system/width of the rope mat at the point of the diverting pulley system is preferably at most 2 (bending diameter in this context means the diameter with which the diverting pulley system bends the ropes of the rope mat). In this way the size of the floor hole of the machine room does not need to be enlarged to a size that would weaken its strength. This is good more particularly when the intent is modernization, because it is awkward to compensate possible expansion of the hole by increasing the strength of the existing machine room floor. Owing to the large width in the axial direction, a diverting pulley system also refrains from tipping over when supported by the hoisting roping. A diverting pulley system can comprise one diverting pulley or a number of diverting pulleys that are connected joined together.

Preferably the ends of the roping are fixed in a suitable phase before or after the aforementioned lowering of the elevator to a suitable point, so that at least at the end of the method they are fixed to a suitable location, preferably to the building.

Preferably the diverting pulley system being lowered, when reeved, comprises holding means for holding the hoisting roping against the diverting pulley system. These means can comprise e.g. limiter means (such as e.g. jump guards) near the surface of the diverting pulley in the radial direction, which prevent the rope(s) of the hoisting roping from leaving the rope groove of the diverting pulley system.

In the method according to the invention for modernizing an elevator, an old elevator in service having a suspension ratio of 1:1 is modernized into an elevator having a suspension ratio of 2:1, in which method the hoisting roping of the old elevator is removed and new hoisting roping is installed. The new hoisting roping is installed according to any of the methods described above. In this way an old elevator can be quickly and efficiently modernized with minor modifications.

In one embodiment an old geared hoisting machine is replaced with a gearless one.

In one embodiment the new hoisting roping is arranged to travel from the traction sheave to the elevator car via a hole in the floor of the machine room, via which hole the old hoisting roping traveled from the traction sheave of the old hoisting machine to the elevator car, and the new hoisting roping is arranged to travel from the traction sheave to the counterweight via a hole in the floor of the machine room, via which hole the old hoisting roping traveled from the traction sheave of the old hoisting machine to the counterweight.

The elevator is most preferably an elevator applicable to the transporting of people and/or of freight, which elevator is installed in a building, to travel in a vertical, or at least essentially vertical, direction, preferably on the basis of landing calls and/or car calls. The elevator car preferably has an interior space, which is most preferably suited to receive a passenger or a number of passengers. The elevator preferably comprises at least two, preferably more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein.

DETAILED DESCRIPTION OF THE INVENTION

Figure 1:
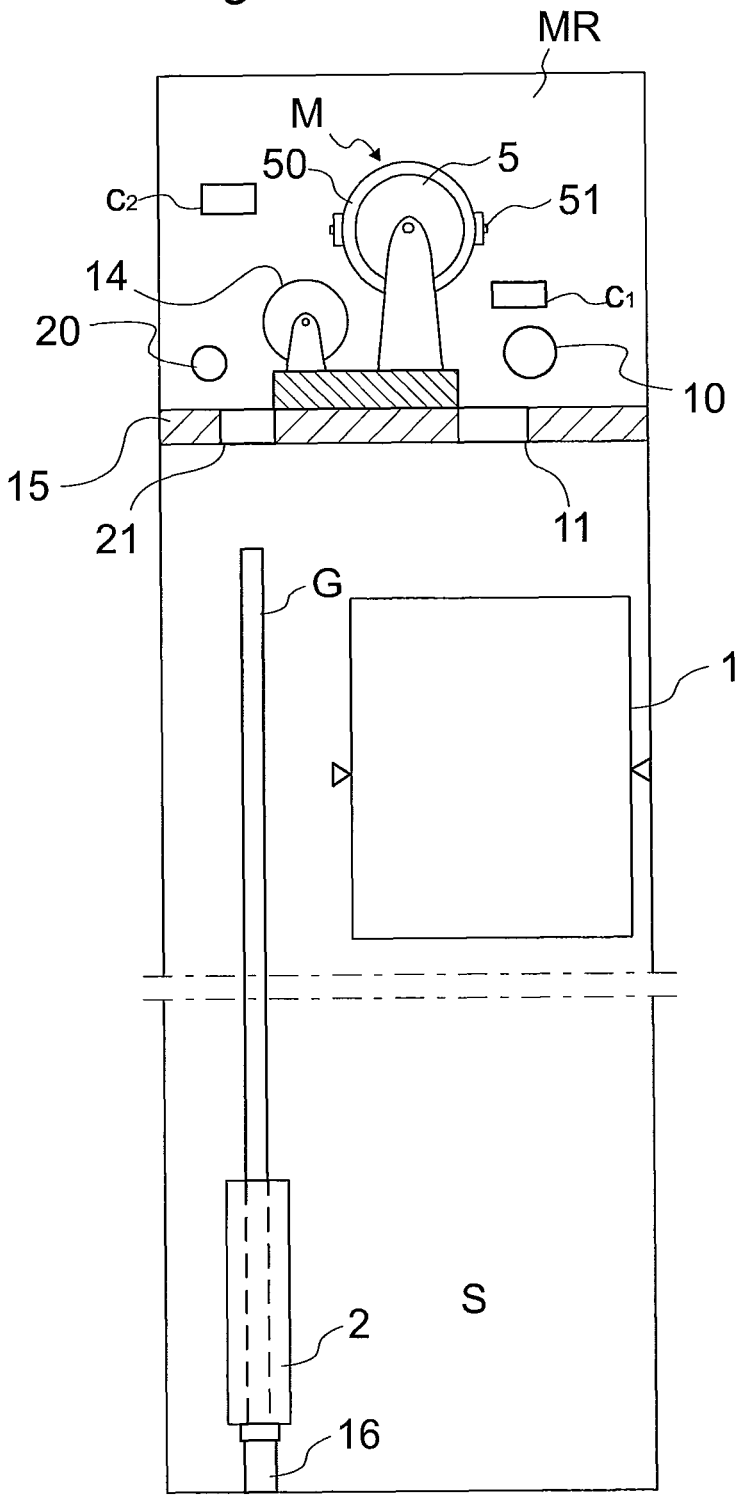
FIG. 1 presents a phase of the method according to the invention, before the reeving of the elevator.

FIGS. 1-6 present in sequence a method, wherein hoisting roping R to be installed in an elevator is arranged to travel over a diverting pulley 5 and to support the elevator units (1,2) of the elevator that are to be moved while supported on the diverting pulley 5 that is supported in its position in a manner allowing its rotation, which diverting pulley here is a traction sheave in a machine room MR above the elevator hoistway S, by connecting the first section a of the hoisting roping R on the first side of the diverting pulley 5 to support the first elevator unit 1 and by connecting the second section b of the hoisting roping R on the second side of the diverting pulley 5 to support the second elevator unit 2, such that the first a and the second section b of the hoisting roping R support their elevator units via a diverting pulley system (10,20). The ends of the hoisting roping R are fixed to a suitable point, more particularly to the building in the manner presented, preferably to the machine room, but the ends can also be fixed elsewhere.

Figure 2:
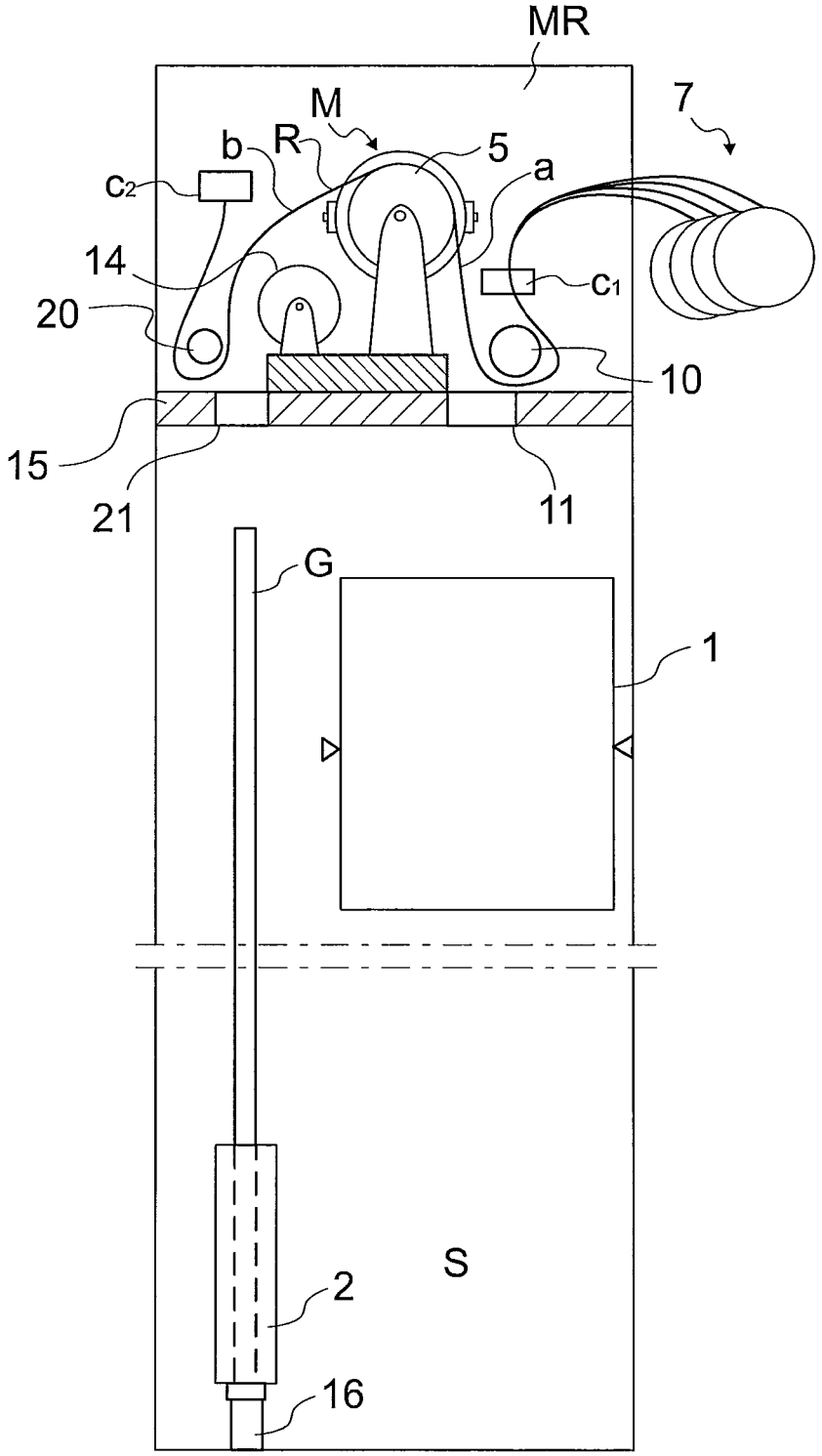
FIG. 2 presents a phase of the method according to the invention, in which phase the hoisting roping of the elevator is pre-reeved to travel under the diverting pulley systems and over the traction sheave.

FIG. 1 presents a phase in the method for installing the hoisting roping R of an elevator. Before reeving, the components are placed according to the configuration presented in the figure. The first elevator unit 1 to be moved, which in this embodiment is an elevator car, is disposed at a suitable point in the elevator hoistway S, which here is the top end of the elevator hoistway S, which here means the top position of the elevator car or the proximity of it. The elevator car is supported in this position so that it remains stationary. The second elevator unit 2 to be moved, which in this embodiment is a counterweight, is also disposed at a suitable point in the elevator hoistway S, more particularly lower than the first elevator unit, and supported in its position so as to be stationary. Preferably the counterweight 2 is disposed in the bottom end of the elevator hoistway S, i.e. in its bottom position or in the proximity of it. In the embodiment presented the counterweight 2 is disposed in the bottom end of the elevator hoistway S to rest on top of its buffer 16. The counterweight 2 is preferably already arranged on its guide rails 22 already in this phase. In addition, it is arranged to dispose the hoisting machine M of the elevator in the machine room MR of the elevator, which hoisting machine comprises a diverting pulley 5 supported in its position in a manner allowing its rotation, which diverting pulley is in this embodiment is a traction sheave 5 to be rotated with a motor 50. In addition, the diverting pulley system 10 of the first elevator unit 1 and the diverting pulley system 20 of the second elevator unit 2, as well as the rope clamps C1 and C2, are arranged to be disposed in the machine room MR. In this phase also a deflector diverting pulley 1 can be arranged to be disposed in the machine room, but it can be disposed also later, and on the other hand it is not even needed in all elevators. Holes 11,21 are arranged through the floor 15 of the machine room between the machine room MR and the elevator hoistway S preferably in this phase if they have not been arranged earlier. FIG. 2 presents a phase that is performed when the traction sheave 5 is already in its position. In this phase the pre-reeving is performed, wherein hoisting roping is fed in from a rope storage 7, in this embodiment from rope reels 7, under the diverting pulley system 10 of the first elevator unit and onwards over the traction sheave 5 and onwards under the diverting pulley system 20 of the second elevator unit. This is done preferably with the free end of the hoisting roping in front. The free end of the hoisting roping R is preferably fixed already in this phase to a supporting point, which can be e.g. a rope clamp C2, which most preferably is the final rope clamp of the roping R. In this way the first section a of the hoisting roping R on the first side of the diverting pulley 5 is arranged to travel under the diverting pulley system 10 of the first elevator unit 1 when the aforementioned diverting pulley system 10 is still separate from the first elevator unit 1, more particularly when the diverting pulley system 10 is still in the machine room MR. In this way the section a between the end of the first section a of the hoisting roping R, which end in this phase can still be in the rope storage 7 (e.g. on a reel), and the diverting pulley 5 travels under the diverting pulley system 10. The hoisting roping R is guided from the rope storage 7 onwards to the diverting pulley system 10 preferably already in this stage through the rope clamp C1, which rope clamp is supported in its position (support not presented) and of the type that the rope(s) can be guided to travel through aperture(s) it comprises (e.g. the aperture can be a channel open upwards and downwards, into which the rope(s) will later be tightened, e.g. with an ordinary tubular wedge housing). In this way the ropes of the hoisting roping R do not escape the rope clamp C1 and remain well under control. The rope storage 7 is also preferably in the machine room MR. In the embodiment presented, the hoisting roping comprises a plurality of ropes, which are guided to travel the same route side by side. In the machine room MR there is preferably an own rope reel for each rope of the hoisting roping, from which reel rope can be discharged during the threading. With the pre-reeving the second section b of the hoisting roping R on the second side of the diverting pulley 5 is correspondingly arranged to travel under the diverting pulley system 20 of the second elevator unit 2 when the aforementioned diverting pulley system 20 is still separate from the second elevator unit 2, more particularly when the diverting pulley system 20 is still in the machine room MR. In this way the section b between the end of the second section a of the hoisting roping R and the diverting pulley 5 travels under the diverting pulley system 10.

Figure 3:
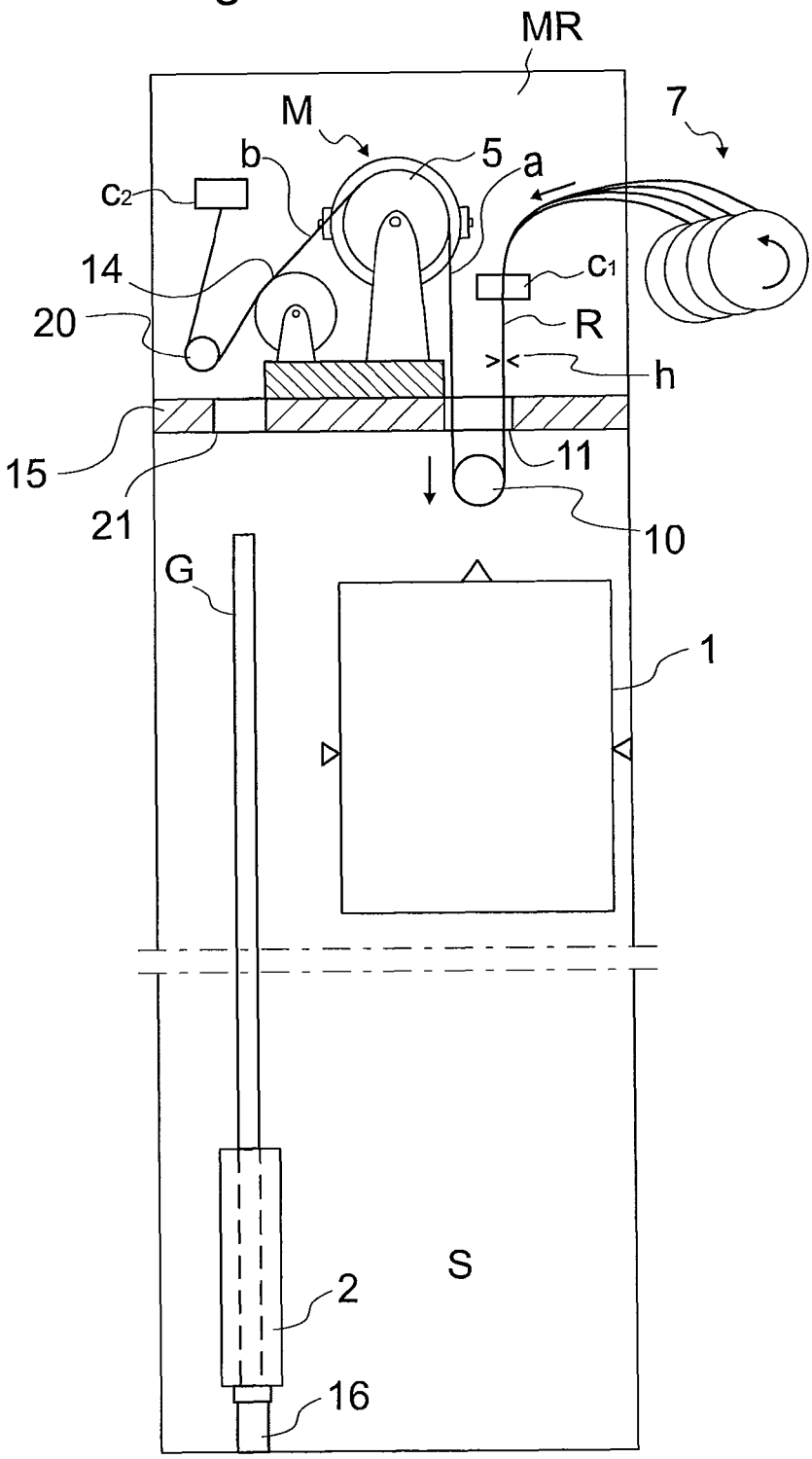
FIG. 3 presents a phase of the method according to the invention, in which phase the hoisting roping is connected to the first elevator unit.

FIG. 3 presents a phase of the method, wherein the diverting pulley system 10 is lowered, when reeved, out of the machine room MR through the aperture 11 in the floor 15 of the machine room MR into the elevator hoistway S. It is lowered, when reeved, downwards into the proximity of its elevator unit 1, after which it is fixed to its elevator unit, i.e. here to the elevator car 1. This lowering can be implemented such that the diverting pulley system 10 is lowered, when reeved, downwards towards the elevator car 1, preferably until it is in the proximity of it, supported by the part a of the hoisting roping R traveling under the diverting pulley system 10 in question. In this way the lowering is simple and fast to implement. The weight of the diverting pulley makes the lowering controlled and easily guided, while keeping the roping R tensioned and therefore straight. For enabling the lowering, the diverting pulley system 10 is taken onto the support of the hoisting roping R, preferably by gripping the hoisting roping R at a point between the diverting pulley system 10 and the rope storage 7, and preferably also at a point between the traction sheave 5 and the diverting pulley system 10. In this way the section a of the hoisting roping R traveling under the diverting pulley system 10 is supported from supporting points (h and a corresponding second gripping point, not presented in the figure), which act on the hoisting roping R on opposite sides of the diverting pulley system 10. The gripping points in this case form the aforementioned supporting points. Gripping is preferably performed manually in the machine room MR. Alternatively it is not needed to grip from the traction sheave 5 side, but instead the traction sheave 5 can form a gripping point on the second side. When the diverting pulley system 10 is supported, the diverting pulley system 10 is displaced to the point of the hole 11 and lowered through the hole 11. The mass of the diverting pulley system pulls hoisting roping from the storage 7 when the person gripping the hoisting roping R releases his/her grip on the hoisting rope such that the diverting pulley system descends through the hole 11 and downwards in the hoistway S. When lowering hoisting roping can be released in this way from the rope storage 7. When the diverting pulley system 10 is in the proximity of its elevator unit, it is fixed to its elevator unit 1. Since the elevator car has been situated in the top end of the elevator hoistway, the lowering of the diverting pulley system 10 to it takes place promptly. Since the counterweight 2, for its part, has been situated in the bottom end of the hoistway, the rope dimensions will automatically settle to correspond to the final elevator or at least to be nearly correct. The positioning of the car 1 is advantageous also because in this way it is possible on its platform to assist the diverting pulley systems descending into the hoistway S. After the lowering of the diverting pulley system 10, the diverting pulley system 20 of the second elevator unit 2 is lowered, preferably in a manner corresponding to what is presented above, when reeved, out of the machine room MR through the aperture 21 in the floor 15 of the machine room MR into the elevator hoistway S supported by the part b of the hoisting roping R traveling under the diverting pulley system 20 in question. In this case the diverting pulley system 20 is taken onto the support of the hoisting roping R, preferably by gripping the hoisting roping R at a point between the diverting pulley system 20 and the traction sheave 5, and also at a point between the diverting pulley system 20 and the rope clamp C2. In this way the section a of the hoisting roping R traveling under the diverting pulley system 10 is supported from the supporting points (gripping points on both sides), which act on the hoisting roping R on opposite sides of the diverting pulley system 20. This gripping also is preferably performed manually in the machine room MR. Alternatively, gripping on both sides or on the one side manually is not indispensable, because the traction sheave 5 can form a supporting point on the one side and/or another supporting point, such as a rope clamp C2, on the other side. When the diverting pulley system 10 is supported on both sides, the diverting pulley system 10 is displaced to the point of the hole 11 and lowered through the hole 11. The additional rope needed can be taken from opposite side of the traction sheave 5 or otherwise a suitable surplus of rope has earlier been reeled to the diverting pulley system 20 side. The diverting pulley system descends through the hole 21 pulled by its weight when the person gripping the hoisting roping R releases his/her grip on the hoisting rope so that the length of the part of the hoisting roping R between the supporting points increases.

Figure 4:
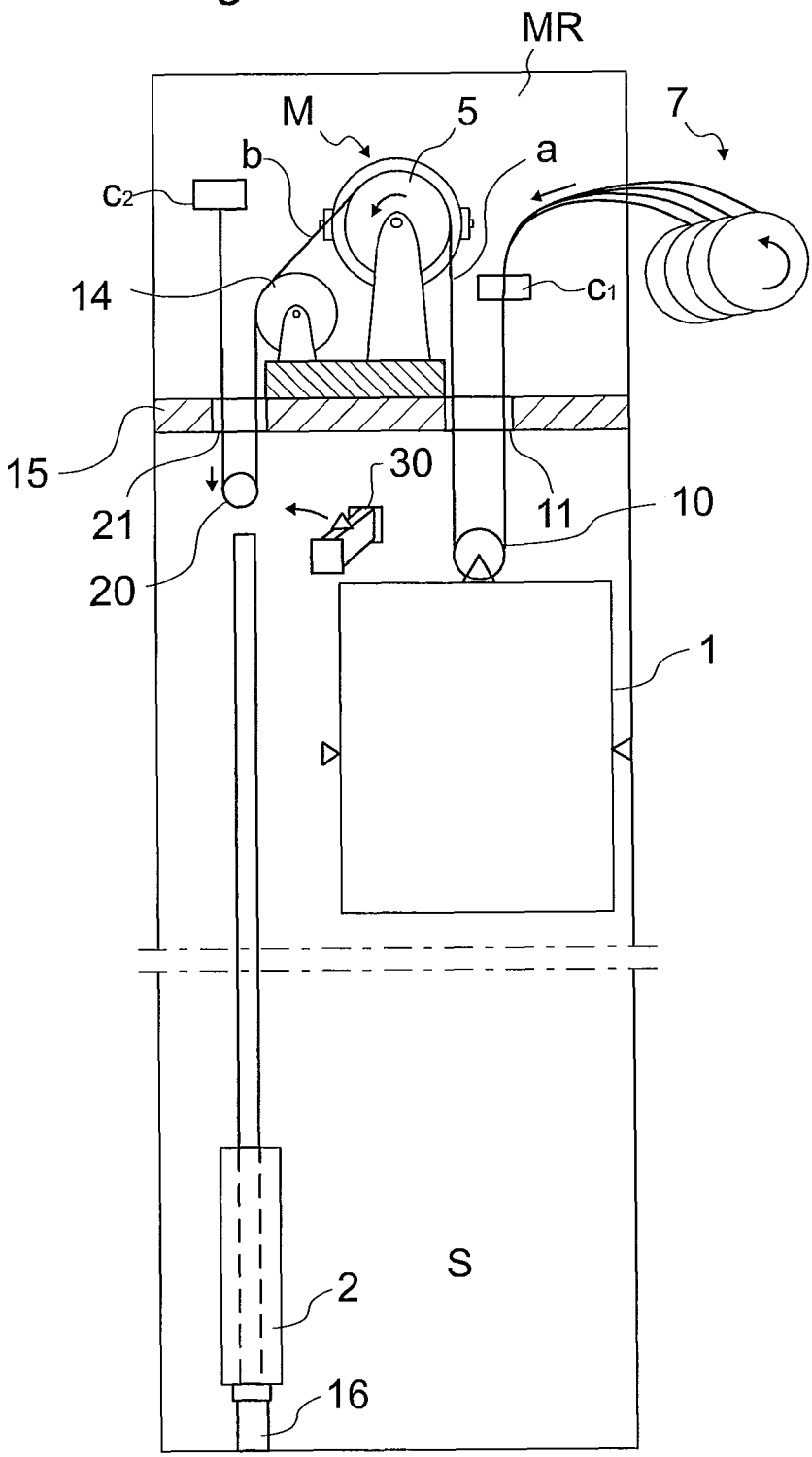
FIG. 4 presents a phase of the method according to the invention, in which phase the diverting pulley system of the second elevator unit has been lowered into the elevator hoistway and it is lowered farther for connecting the hoisting roping to the second elevator unit.

FIG. 4 presents a later stage than FIG. 3, wherein the diverting pulley system 10 is already attached to its elevator unit 1 and the diverting pulley system 20 is in the elevator hoistway S. In this phase the diverting pulley system 20 of the second elevator unit is further lowered towards its elevator unit 2, here therefore towards the counterweight 2, supported by the part b of the hoisting roping R traveling under the diverting pulley system 20 in question. In this way the lowering in the elevator hoistway S is simple and fast to implement. The weight of the diverting pulley system makes the descent controlled and easily guided, while keeping the roping R tensioned and therefore straight.

The lowering is performed such that the diverting pulley system 20 is lowered, when reeved, downwards towards its elevator unit 2 supported by the part b of the hoisting roping R traveling under the diverting pulley system 20 by supporting the section b of hoisting roping R traveling under the diverting pulley system 20 on the supporting points 5 and C2, which act on the hoisting roping R on opposite sides of the diverting pulley system 20, and by lengthening the length of the part of the hoisting roping R between the supporting points (5 and C2) until the diverting pulley system 20 has descended to a suitable point. In this case the traction sheave 5 on one side of the diverting pulley system and the supporting point C2, which can be e.g. a rope clamp, most preferably the final rope clamp of the roping R, on the other side form the supporting points. In this manner the diverting pulley system 20 is first lowered into the proximity of its elevator unit 2, after which it is fixed to its elevator unit, i.e. here to the counterweight 2. However, it is advantageous that in the starting phase of this lowering the diverting pulley system 20 is fixed to a guidance device 30, which comprises guides, such as e.g. sliding guides or roller guides, which are supported to take lateral support from the guide rails G of the elevator, after which the diverting pulley system 20 is lowered, when reeved, downwards into the proximity of its elevator unit 2 guided in the lateral direction by the guidance device 30. Preferably when the diverting pulley system is at a suitable point, preferably already lowered into the elevator hoistway S side, while working on a platform, preferably on the roof, of the first elevator unit (here, therefore, the elevator car 1) in the top end of the elevator hoistway, the lowering of the diverting pulley system of the second elevator unit can be prepared, preferably while working on the roof the diverting pulley system of the second elevator unit is fixed to the guidance device 30. Likewise, the guidance device 30 is placed onto the guide rails G, after which the diverting pulley system can be further lowered down in a controlled manner towards its elevator unit. In the embodiment presented, the guide rails are the guide rails of the elevator unit, to which elevator unit the diverting pulley system is lowered guided by the guide rails, i.e. here the guide rails of the counterweight 2. There are preferably two guide rails G, and the aforementioned guidance device 30 is disposed between them to take guidance from the two guide rails.

Preferably when lowering the diverting pulley system 20, the length of the part of the hoisting roping R between the supporting points (5 and C2) is increased by displacing the hoisting roping R over the diverting pulley 5 from the first side to the second side by rotating the diverting pulley 5 (in the direction of the arrow in FIG. 4), and the hoisting roping R is arranged to be released at the same time on the first side of the diverting pulley 5 from the rope storage 7, which in the embodiment presented is a plurality of rope reels, from which the hoisting roping R travels to the first elevator unit, and onwards to the diverting pulley 5. The aforementioned diverting pulley 5 is in this case preferably the traction sheave of the hoisting machine of the elevator, on which traction sheave a power means operating with the elevator control, and a brake, are arranged to act. In the aforementioned increasing of the length between supporting points, the traction sheave 5 is rotated by driving the hoisting machine of the elevator, preferably by driving the hoisting machine in the service drive mode of the elevator. Rotation of the traction sheave is effected by aid of the drive of the hoisting machine, which acts on the traction sheave via the power means (motor 50) of the hoisting machine. In this way, therefore, either the rotation of the traction sheave 5 is allowed or if necessary causing rotation in it (with the motor 50, e.g. if at first the self-mass of the diverting pulley 20 and the ropes does not yet exceed the resistance of the roping on the second side of the traction sheave), depending on the prevailing power balance. An alternative to the driving of the hoisting machine is the releasing (e.g. manually) of the machinery brake 51 such that it brakes the rotation of the traction sheave and thus the lowering of the diverting pulley system (10,20) is controlled.

Figure 5:
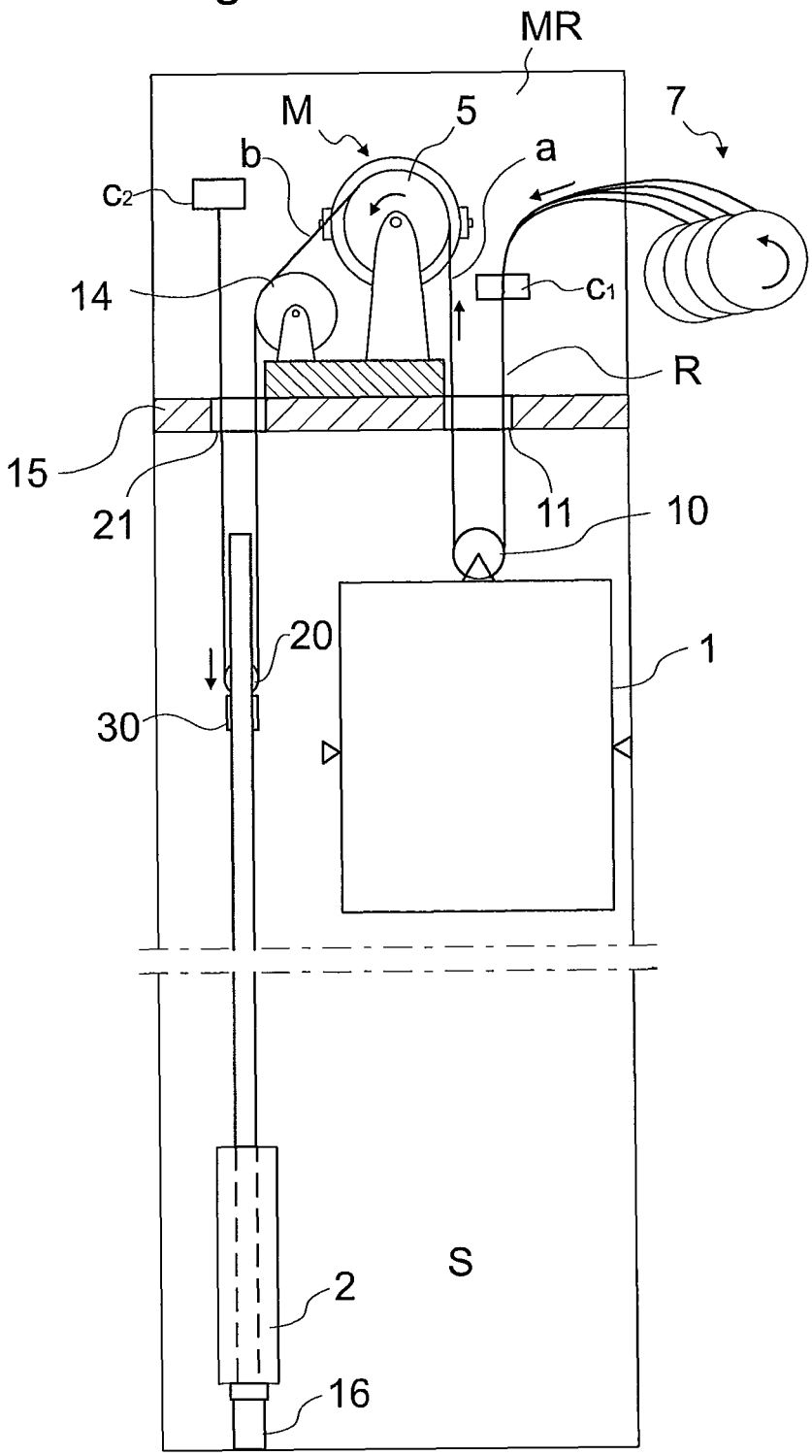
FIG. 5 presents a phase of the method according to the invention, in which phase the diverting pulley system of the second elevator unit is lowered in an advantageous manner towards its elevator unit.

FIG. 5 presents a later stage than FIG. 4, in which the diverting pulley system 20 is lowered in the manner presented above by the aid of the traction sheave 5. In this case rope is released from the rope storage 7, running through the elevator system. The length of the part of the hoisting roping R between the supporting points (5 and C2) increases and the diverting pulley system 20 descends towards the counterweight 2. The diverting pulley system 20 moves downwards guided in the lateral direction by the guidance device 30. The rope clamp C1 is kept in the type of state that the hoisting roping is able to run via it.

Figure 6:
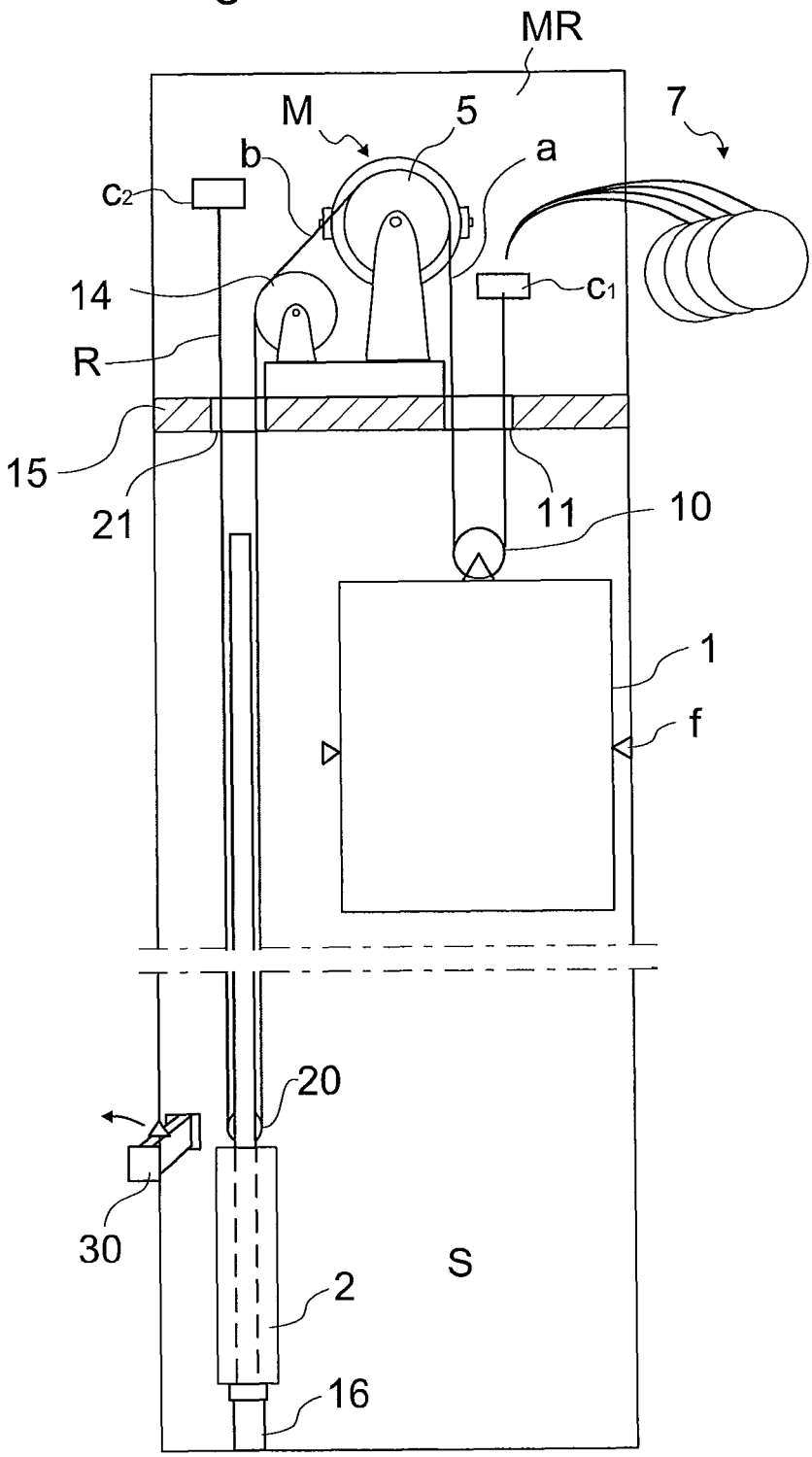
FIG. 6 presents a phase of the method according to the invention, in which phase the hoisting roping has been connected to the second elevator unit.

FIG. 6 presents a later stage than FIG. 5, to reach which the diverting pulley system 20 has been lowered into the proximity of its elevator unit, fixed to it, and the guidance device has been removed. The hoisting roping R is truncated (if the length is not otherwise suitable) near the rope clamp C1, and the hoisting roping R is fixed to the rope clamp C1. After this the supporting f of the elevator car 1 in its position can be released and the elevator is ready for use, at least in respect of the rope installation. As presented in the figure, the hoisting roping travels from the fixing point C1 of the first end under the diverting pulley system 10 connected to the first elevator unit 1 and upwards to the machine room M above the elevator hoistway S via the hole 11 in its floor 15 and over the traction sheave 5 via the aperture 21 in the floor of the machine room under the diverting pulley system 20 connected to the second elevator unit and to the fixing point C2 of the second end.

Figure 7:
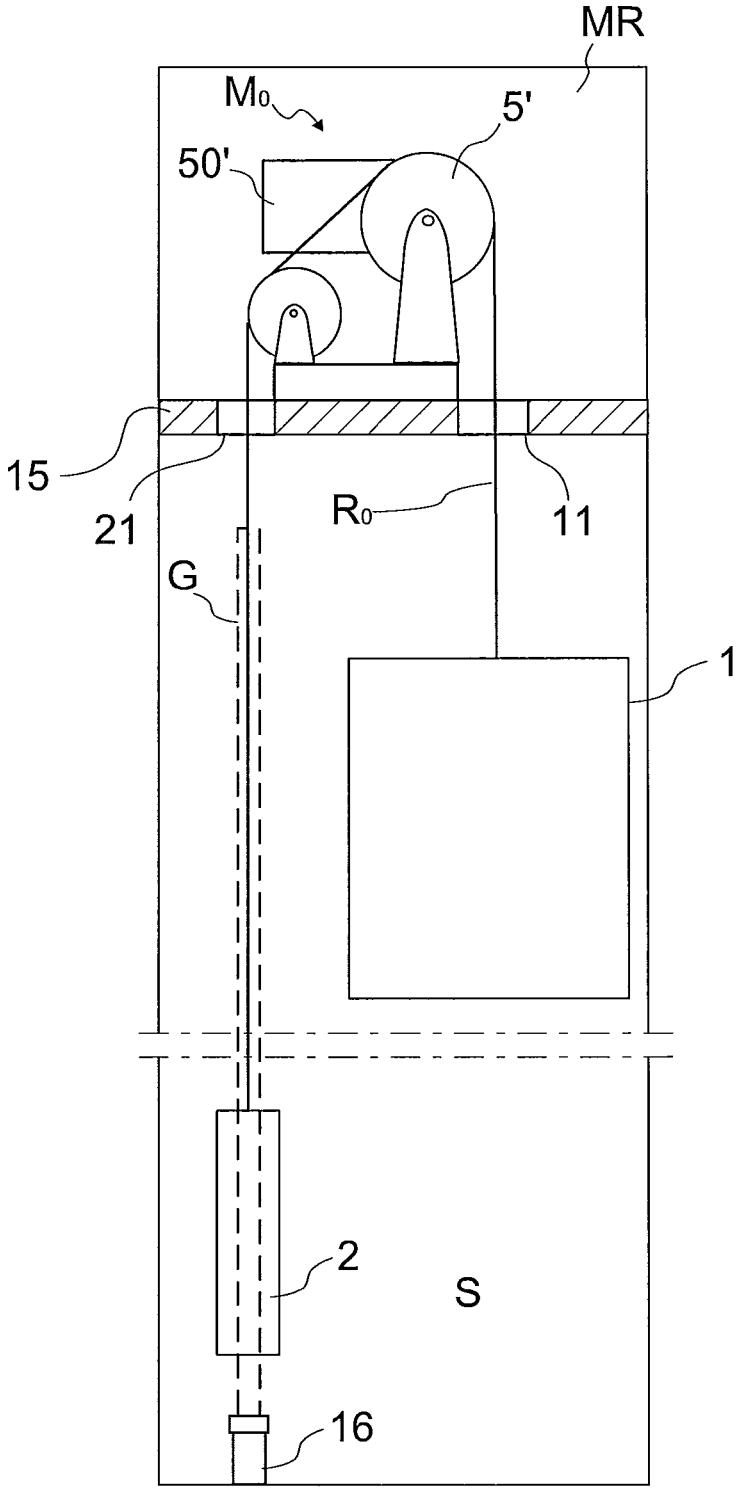
FIG. 7 presents an old elevator that is in service, which can be modernized by replacing its old hoisting roping with a new one using the method according to the invention.

With the method presented above e.g. a new elevator can be fabricated or an old elevator can be reeved in connection with a rope replacement so that the elevator to be formed is of the type presented in FIG. 6. This is also so in the case of modernization. FIG. 7 presents an old elevator, which it is advantageous to modernize using the method presented so that the elevator to be formed is of the type presented in FIG. 6. In this case the counterweight 2 and the elevator car are preserved, and the hoisting machine M0 with its traction sheave and motor are removed, and the old roping is removed. The new roping is installed in the manner presented in FIGS. 1-6, preferably to travel via the floor holes 11, 21 of the machine room of the elevator to be modernized. The elevator of FIG. 7 is a 1:1 elevator, which with the method according to FIGS. 1-6 can be modernized into a 2:1 elevator. The old hoisting machine is replaced with a new one. For example, the motor 50' is replaced with a new motor 50 and the traction sheave 5' with a new traction sheave 5. It is particularly advantageous that an old geared hoisting machine is replaced with a gearless machine that is more space-efficient. In this way extra space is achieved in the machine room MR and the change in lifting ratio compensates for the removal of the gear. In the method the new hoisting roping is preferably arranged to travel from the traction sheave 5 to the elevator car 1 via a hole 11 in the floor 15 of the machine room MR, via which hole the old hoisting roping R0 traveled from the traction sheave 5' of the old hoisting machine M0 to the elevator car 1, and the new hoisting roping is arranged to travel from the traction sheave 5 to the counterweight 2 via a hole 21 in the floor 15 of the machine room MR, via which hole the old hoisting roping R0 traveled from the traction sheave 5' of the old hoisting machine M0 to the counterweight 2. In this way an old elevator can be simply and efficiently modernized and the structures of the old elevator utilized. The method can comprise a phase preceding the lowering of the diverting pulley unit into the hoistway, in which phase the aforementioned old holes are formed to be larger.

Generally speaking, the hoisting roping R is preferably of the type that it comprises a plurality of ropes, preferably at least 8 ropes, preferably at least 16 ropes, although there could be only one rope. In this context the method works extremely advantageously and provides great benefits because the ropes in this case are narrow and bend in a small space. Another advantage is that a large plurality of ropes would otherwise be laborious to reeve. Further, the hoisting roping R is preferably such that it comprises a plurality of ropes that bend around the aforementioned diverting pulley system (10,20) side by side concentrically. In this way the conveying of the diverting pulley system through a narrow hole 11 or 21 is straightforward, and there is no need to enlarge them and thus weaken the floor structure. In order to achieve this advantage, it is also preferred that the hoisting roping R comprises a plurality of ropes, which bend side by side around the diverting pulley system (10,20), forming a rope mat comprising parallel ropes, and the ratio of the bending diameter of the diverting pulley system/width of the rope mat at the point of the diverting pulley system is preferably at most 2 (bending diameter in this context means the diameter with which the diverting pulley system bends the ropes of the rope mat). In this way an elevator can be reeved to comprise a large number of ropes. They can be formed to be thin and therefore to bend in a small space and therefore the diverting pulley system becomes compact. The term hoisting roping/rope is understood in this context to relate to flexible rope-like elements of an elevator, including ropes that are round or flat in their cross-section. Preferably, however, at issue is hoisting roping that comprises a plurality of ropes having a round cross-section, preferably metal ropes. The elevator units are preferably in their position during the method, preferably at least during the lowering of the diverting pulley system/diverting pulley systems 10,20, until the diverting pulley system has been fixed to the elevator unit in question.

The end of the first section of the hoisting roping can, in the embodiment presented in FIG. 2, be the end that is still inside the reel 7. There can be a need, however, to shorten the length of the roping R to other than the length that was on the reel, so it is understandable that, in the different phases of the method, when talking about the end of section a, what is referred to is the end of the section at the time of the phase in question.

In the embodiment presented, the first elevator unit 1 is an elevator car and the second elevator unit is a counterweight, but the advantages of the method are also achieved if these are vice versa. The advantages are also achieved if the diverting pulley system of only one of the two elevator units is connected to its elevator unit in the manner presented. In this case the second elevator unit can be supported with a different suspension, e.g. the elevator car could in this case be supported with a 1:1 lifting ratio.

If it is a new elevator at issue, the components according to FIG. 1 are arranged in the newly constructed machine room as new components. If it is an existing elevator at issue, of which only the ropes are being replaced, the aforementioned components can be already in position, or if it is a modernization at issue, the components are arranged in the machine room after first possibly removing the existing components. Likewise in the method holes 11,21 are arranged in the floor 15 of the machine room, if no such holes exist.

The term elevator unit (1,2) occurring in places in this application refers to an elevator unit (1,2) to be moved. Correspondingly, the term diverting pulley (5) refers to a diverting pulley (5) supported in its position in a manner allowing its rotation.

The aforementioned diverting pulley supported in its position in a manner allowing its rotation is preferably the traction sheave of a hoisting machine, but not necessarily, because the hoisting force can be produced in the hoisting roping otherwise, e.g. by the aid of an apparatus acting on possible compensating roping.

In the embodiment presented, the diverting pulley system 10,20 is supported on the hoisting roping R when it is lowered through the aperture. However, in this phase the diverting pulley system could be lowered, when reeved, to the elevator hoistway side supported in some other way, e.g. by manually gripping the diverting pulley system. In this case after lowering the diverting pulley system 10,20 into the elevator hoistway, it would be advantageous to further lower it towards its elevator unit while supported by the part of the hoisting roping traveling under the diverting pulley system in question.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. Method for installing a hoisting roping of an elevator, in which method a first elevator unit to be moved is disposed at a suitable point in an elevator hoistway, and a second elevator unit to be moved is disposed at a suitable point in the elevator hoistway, said first elevator unit being an elevator car and said second elevator unit being a counterweight, or vice versa, the hoisting roping is arranged to travel over a diverting pulley supported in its position in a manner allowing its rotation and to support the elevator units while supported on the diverting pulley in question, by connecting a first section of the hoisting roping on a first side of the diverting pulley to support the first elevator unit and by connecting a second section of the hoisting roping on a second side of the diverting pulley to support the second elevator unit, such that the first and/or the second section of the hoisting roping support(s) their elevator unit(s) via a diverting pulley system, wherein in the method the first section and/or the second section of the hoisting roping is/are connected to their elevator units via the diverting pulley system of the elevator unit such that when the diverting pulley system is still separate from the elevator unit, the section in question of the hoisting roping is arranged to travel under the diverting pulley system of its elevator unit, and the diverting pulley system is lowered, when reeved, downwards into the proximity of its elevator unit, after which the diverting pulley system in question is fixed to its elevator unit.

2. Method according to claim 1, wherein before the lowering of the diverting pulley system(s), when reeved, downwards into the proximity of its/their elevator unit(s), the hoisting roping is arranged to travel over the diverting pulley.

3. Method according to claim 2, wherein before the diverting pulley system(s) is/are lowered out of a machine room into the elevator hoistway, the hoisting roping is arranged to travel over the diverting pulley.

4. Method according to claim 2, wherein before the lowering of the diverting pulley system(s), when reeved, downwards into the proximity of its/their elevator unit(s), the hoisting roping is arranged to travel under the diverting pulley system of the first elevator unit and to the diverting pulley, and over the diverting pulley and onwards under the diverting pulley system of the second elevator unit.

5. Method according to claim 1, wherein the diverting pulley is a traction sheave of a hoisting machine of an elevator.

6. Method according to claim 1, wherein the diverting pulley system is lowered, when reeved, downwards towards its elevator unit supported by the part of the hoisting roping traveling under the diverting pulley system in question.

7. Method according to claim 1, wherein in the method the diverting pulley system is lowered, when reeved, downwards towards its elevator unit supported by the part of the hoisting roping traveling under the diverting pulley system in question by supporting the section of hoisting roping traveling under the diverting pulley system while supported on supporting points, which act on the hoisting roping on opposite sides of the diverting pulley system.

8. Method according to claim 1, wherein in the method the diverting pulley system is lowered, when reeved, downwards towards its elevator unit supported by the part of the hoisting roping traveling under the diverting pulley system in question by supporting the section of hoisting roping traveling under the diverting pulley system while supported on supporting points, which act on the hoisting roping on opposite sides of the diverting pulley system and by lengthening the length of the part of the hoisting roping between the supporting points until the diverting pulley system has descended to a suitable point.

9. Method according to claim 7, wherein the one supporting point is the diverting pulley, which is a traction sheave of a hoisting machine of the elevator.

10. Method according to claim 9, wherein the other supporting point is a supporting device of an end of the hoisting roping.

11. Method according to claim 7, wherein at least the one supporting point is formed by manually gripping the roping.

12. Method according to claim 7, wherein in the method a length of the part of the hoisting roping between the supporting points is increased by displacing the hoisting roping over the diverting pulley from the first side to the second side by rotating the diverting pulley, and the hoisting roping is arranged to be released at the same time on the first side of the diverting pulley from a rope storage, from which the hoisting roping travels to the first elevator unit.

13. Method according to claim 1, wherein in the method the diverting pulley is a traction sheave of a hoisting machine of an elevator, and the traction sheave is rotated by driving the hoisting machine of the elevator.

14. Method according to claim 13, wherein the traction sheave is rotated by driving the hoisting machine in a service drive mode of the elevator.

15. Method according to claim 1, wherein in the method the section in question of the hoisting roping is arranged to travel under the diverting pulley system of its elevator unit when the diverting pulley system of the elevator unit is still separate from the elevator unit and is disposed in a machine room, after which the diverting pulley system in question is lowered, when reeved, through an aperture in the floor of the machine room into the elevator hoistway.

16. Method according to claim 1, wherein in the method the diverting pulley system is fixed in the elevator hoistway to a guidance device, which comprises guides, which are supported to take lateral support from guide rails of the elevator, after which the diverting pulley system is lowered, when reeved, downwards into the proximity of its elevator unit guided in a lateral direction by the guidance device.

17. Method according to claim 1, wherein in the method the first elevator unit to be moved is disposed in a top end of the elevator hoistway, and supported in its position so as to be stationary, and the second elevator unit to be moved is disposed in the elevator hoistway, in the bottom end of the elevator hoistway or otherwise lower than the first elevator unit, and supported in its position so as to be stationary, and while working on a platform of the first elevator unit in the top end of the elevator hoistway, the lowering of the diverting pulley system of the second elevator unit is prepared.

18. Method according to claim 17, wherein while working on the platform of the first elevator unit in the top end of the elevator hoistway, the lowering of the diverting pulley system of the second elevator unit is prepared by fixing the diverting pulley system of the second elevator unit to a guidance device.

19. Method for modernizing an elevator, wherein an old elevator in service having a suspension ratio of 1:1 is modernized into an elevator having a suspension ratio of 2:1, in which method the hoisting roping of the old elevator is removed and new hoisting roping is installed, wherein the new hoisting roping is installed with a method according to claim 1.

* * * * *